US005864121A

United States Patent [19]

Meyer et al.

[11] Patent Number: 5,864,121

[45] Date of Patent: Jan. 26, 1999

[54] HEATING ELEMENT

[75] Inventors: Jörg Meyer, Ratsenried; Josef Hecht, Erlenmoos, both of Germany

[73] Assignee: AKO-Werke GmbH & Co. KG, Wangen, Germany

[21] Appl. No.: 778,237

[22] Filed: Jan. 8, 1997

[30] Foreign Application Priority Data

Jul. 15, 1996 [DE] Germany ..... 296 00 274 U

[51] Int. Cl.[6] ..... H05B 1/00; H05B 1/02

[52] U.S. Cl. ..... 219/445; 219/446; 219/449; 219/489; 219/486

[58] Field of Search ..... 219/445, 483, 219/486, 446, 464, 465, 466

[56] References Cited

U.S. PATENT DOCUMENTS 3,172,996 3/1965 Sand et al. ..... 219/483

FOREIGN PATENT DOCUMENTS 1 239 034 12/1973 Germany .
33 15 438 10/1984 Germany .

*Primary Examiner*—Teresa J. Walberg
*Assistant Examiner*—Vinod D. Patel
*Attorney, Agent, or Firm*—Scully, Scott, Murphy & Presser

[57] ABSTRACT

A heating element with a radiant heating body for glass ceramic hobs, including four heating conductors which extend substantially concentrically and parallel to each other; and a ten-stage switch for switching said heating conductors through the intermediary of five output terminals.

8 Claims, 3 Drawing Sheets

HEATING ELEMENT

BACKGROUND OF THE INVENTION

1. Field of the Invention

The invention concerns a heating element, preferably a radiant heating body for glass ceramic hobs.

2. Discussion of the Prior Art

Heating elements of the above-indicated kind are known per se. Thus DE 33 15 438 A1 discloses such a heating element which is formed from an insulating carrier and a receiving dish and which, for heating glass ceramic cooking hob areas, is arranged beneath the glass ceramic plate. The heating element has three heating conductors of which two are arranged in series one behind the other, while the third heating conductor extends parallel to them. That arrangement is intended to achieve an improved relationship between heating conductor length and heating conductor output power. A particularly advantageous use arises in the case of radiant heating bodies in order to use a seven-stage switch.

A seven-stage circuit for hot plates, which is also known from a practical context, is disclosed in German patent specification No. 12 39 034. In that arrangement a respective end of two heating conductors or heating spirals is connected to an output terminal of the switch. The remaining four ends of the heating conductors are brought together in pairs and also connected to a respective output terminal. A graduation in terms of output power is achieved by virtue of connecting the output terminal of the switch to the two pole terminals of a dc or ac network system, in a predetermined switching sequence. That patent specification is based on the realisation that, while retaining the known seven-stage switch arrangement, it is not possible to provide between switching stages II and I a further switching position in which the third output terminal is not connected to one of the two pole terminals. It was therefore necessary to look for a way of completely avoiding that pole change without in that respect anything changing in terms of the series connection of the three heating conductors in the first switching position of the series circuit of the second and third heating conductors in switching position II. Therefore, in accordance with patent specification No. 12 39 034, the inevitable pole change was effected on the one hand in relation to switching positions II and IV and on the other hand in relation to switching positions IV and II. More specifically, in the former case the neutral switching position III is between the pole change, while in the second case that involves the two neutral positions I and OFF.

Those heating elements in the state of the art have been found to suffer from the disadvantage of the excessively great power graduation effect and the temperature distribution, which is at least in part not an optimum one, in regard to seven-stage heating with a seven-stage switch. It was further realised that the energy regulator cycles the output power in respect of time. As a result in the low output power stages the energy regulator has excessively long OFF-times.

SUMMARY OF THE INVENTION

Therefore the object of the present invention is to provide a heating element of the kind set forth herein, preferably such as a radiant heating body for glass ceramic hobs, in which an improved temperature distribution and generally optimised output power graduation is achieved by virtue of a particular arrangement of the heating conductors.

In accordance with the invention that object is attained by the provision of four heating conductors which extend substantially concentrically or parallel to each other, and which can be switched by way of five output terminals by a ten-stage switch.

The features according to the invention provide an inexpensive overall structure in relation to a single-circuit heating arrangement with energy regulator. The arrangement of the heating conductors guarantees a good temperature distribution over the entire heating element and good linear output power distribution. Crossings or intersections in the running of the heating conductors are avoided whereby the connections remain the same. Only a few connections are required by virtue of the optimum combination of the parallel and series circuitry of the heating conductors. An optimum output power graduation effect is achieved for the user by virtue of an approximately linear power curve. In the lowest stage a series circuit configuration provides a stage for keeping food hot, wherein a very low level of power output of about 100 watts for keeping food hot is achieved by virtue of the series-connected heating conductors. At the same time the arrangement affords the maximum possible, uniform temperature distribution over the entire cooking area of the heating element.

BRIEF DESCRIPTION OF THE DRAWINGS

An example of the invention is illustrated in the drawing in which.

DETAILED DESCRIPTION OF A PREFERRED EMBODIMENT

Figure 1:
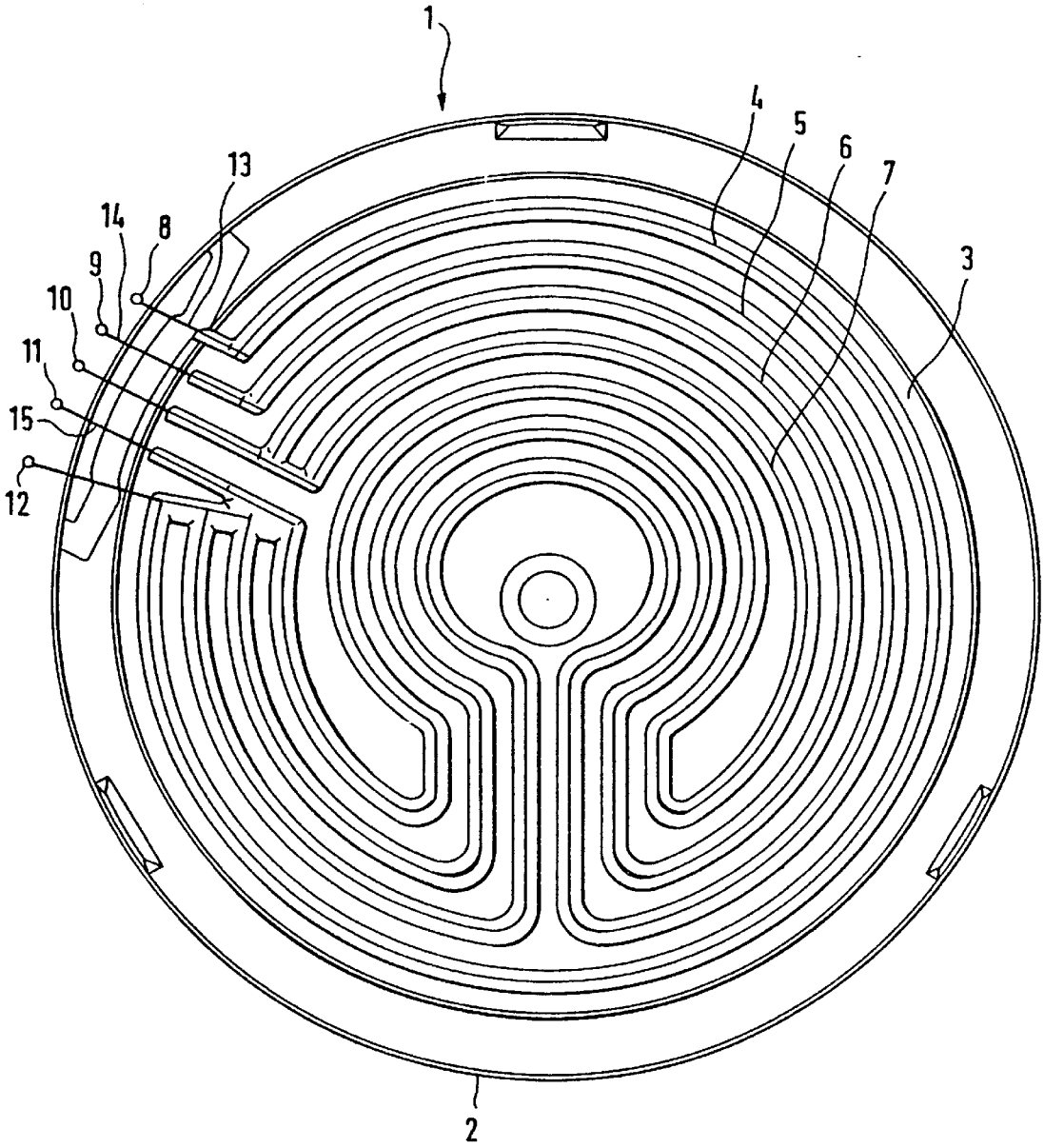
FIG. 1 is a plan view of a heating element with four heating conductors.

The heating element 1 for radiant heating of a glass ceramic plate (not shown here) for an electric cooker has a carrier dish 2 in which an insulating layer 3 is fitted. The insulating layer 3 is provided with annular grooves which are substantially concentrically disposed and which extend partially inwardly and into which are fitted a total of four heating conductors 4, 5, 6 and 7. The heating conductors 4, 5, 6 and 7 are connected to the output terminals 8, 9, 10, 11 and 12. The four heating conductors 4, 5, 6 and 7 all have mutually different resistance values. It will be appreciated that alternatively other arrangements of the heating conductors 4, 5, 6 and 7 in the carrier dish 2 are also possible. What is essential in regard to the arrangement of the heating conductors shown in FIG. 1 is the avoidance of line crossings or intersections, to the output terminals.

Figure 2:
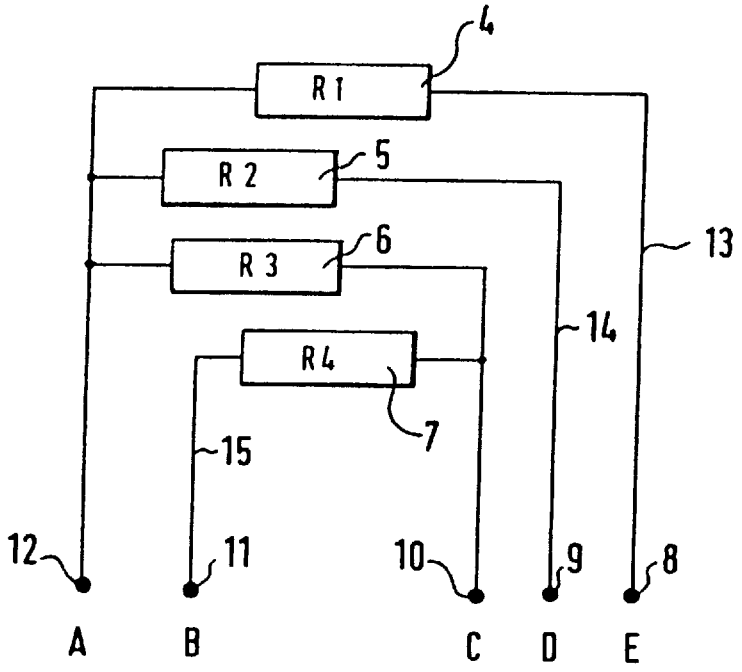
FIG. 2 shows an equivalent circuit diagram of the heating element of FIG. 1.

The circuitry arrangement of the heating element 1 can be clearly seen from the equivalent circuit diagram shown in FIG. 2. It will be seen therein that the terminal 8 is connected by way of the free feed line 13 to the heating conductor 4. The terminal 9 is connected by way of the free feed line 14 to the heating conductor 5. The terminal 10 is connected to the heating conductors 6 and 7 while the terminal 11 is connected by way of the free feed line 15 to the heating conductor 7. Finally the terminal 12 is connected to the heating conductors 4, 5 and 6. The arrangement of the heating conductors shown in FIG. 2 overall provides an optimum output power distribution with an approximately linearly extending power curve from switching stage I to switching stage IX. Further advantages, besides that approximately linear increase in power, are considered to lie in the fact that cycling of an energy regulator in the lower switching stages does not occur and the time to light up to incandescence is very fast because four heating conductors are arranged in parallel. The ten-stage circuit guarantees a fast response time to all switch reactions, in comparison with the electromechanical energy regulator (with bimetal element). Thus the failure rate of the energy regulator as well as the flicker rate and the mains system feed back effects fail to occur.

Figure 3:
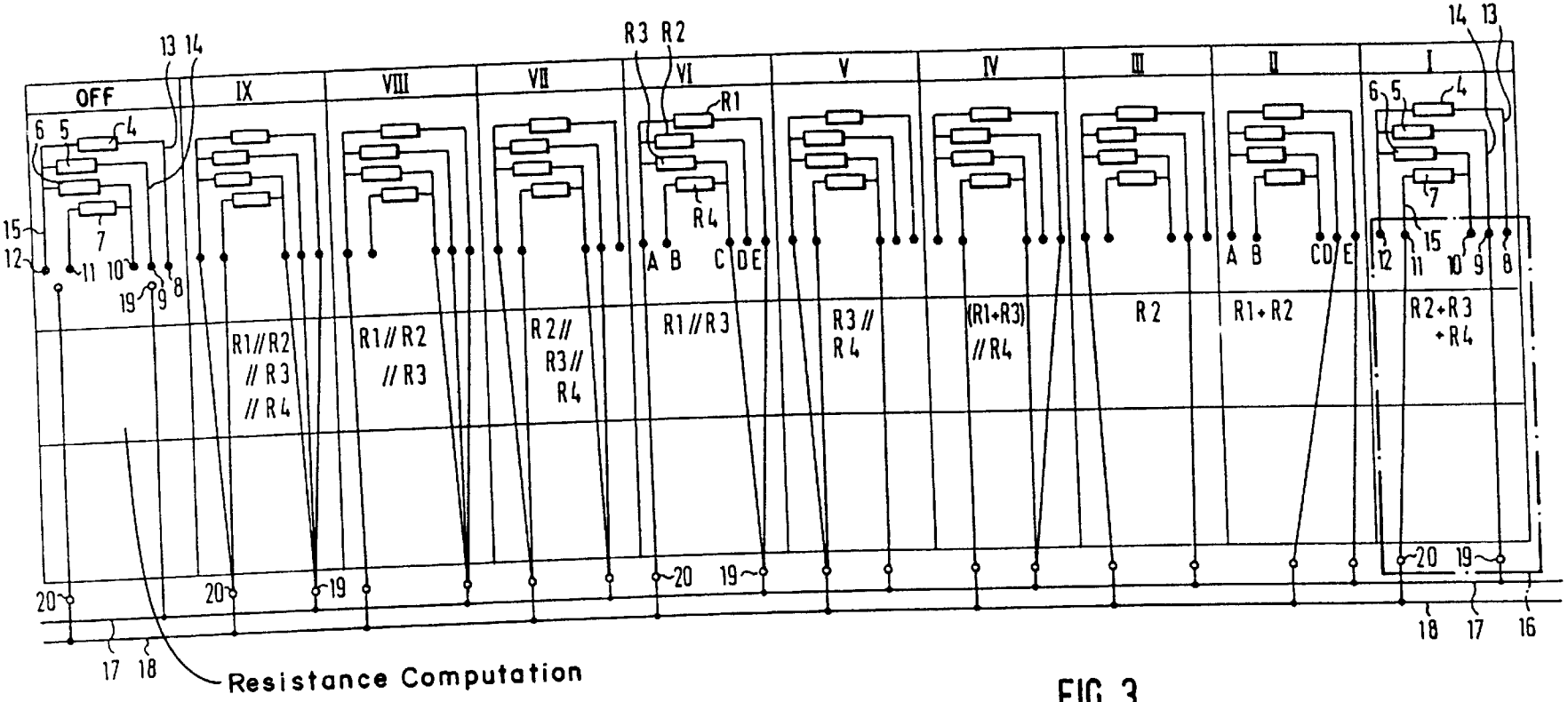
FIG. 3 shows the ten-stage circuit in the form of a block circuit diagram.

FIG. 3 is a block circuit diagram showing the circuit according to the invention with a ten-stage switch. The individual switching stages are identified by Roman numerals I to IX and in the final switching stage by OFF. The arrangement of the heating conductors 4, 5, 6 and 7 with the corresponding feed lines 13, 14 and 15 and the terminals 8, 9, 10, 11 and 12 corresponds in terms of basic structure to the equivalent circuit diagram shown in FIG. 2. Reference numeral 16 identifies in dash-dotted line the two-pole switch which is electrically connected to the lines 17 and 18 of a dc or ac network system. The two poles of the ten-stage switch 16 are identified by references 19 and 20.

In switching stage I which serves for keeping food hot by means of the heating element, the second terminal 11 is connected to the pole 20 of the ten-stage switch 16 and the fourth terminal 9 is connected to the pole 19 of the ten-stage switch 16. In that switching position the heating conductors 5, 6 and 7 are connected in series. The output power is at the lowest level. Temperature distribution appears as an entire unit as the elements are put into circuit in that switch position as shown in FIG. 1, which results in a better output power distribution.

In switching stage II the fourth terminal 9 is connected to the first pole 20 and the fifth terminal 8 is connected to the second pole 19. This configuration involves a series connection of the heating conductors 4 and 5. It is also to be noted here that it is in this single case that a connection is made from the pole 20 to one of the terminals 8, 9 or 10.

In the switching stage III the first terminal 12 is connected to the first pole 20 and the fourth terminal 9 is connected to the second pole 19. This is the only case in which only one heating conductor 5 is switched on.

Switching stage IV shows a connection from the first pole 20 to the second terminal 11 and a further connection from the second pole 19 both to the third terminal 10 and also to the fifth terminal 8. This configuration involves a parallel circuit of the two series-connected heating conductors 4 and 6 in relation to the fourth heating conductor 7.

Switching stage V shows a connection from the first pole 20 to the first and the second terminals 11 and 12. The second pole 19 is connected to the third terminal 10. This provides for parallel connection of the heating conductor 6 in relation to the heating conductor 7.

A further parallel connection is disclosed in switching stage VI in which the heating conductor 4 is connected in parallel with the heating conductor 6. In that configuration the first pole 20 of the ten-stage switch 16 is connected to the first terminal 12 while the second pole 19 is connected to the third terminal 10 and to the fifth terminal 8.

In the switching stage VII there is a connection from the pole 20 to the first terminal 12 and to the second terminal 11. A further connection goes from the pole 19 to the third terminal 10 and to the fourth terminal 9. That provides a parallel connection of the heating conductor 5 in relation to the heating conductor 6 and the heating conductor 7.

In the switching stage VIII of the ten-stage switch 16 the first pole 20 is connected to the first terminal 12 and the second pole 19 is connected to the terminals 8, 9 and 10, thereby providing for a parallel connection of the heating conductor 4 in relation to the heating conductor 5 and the heating conductor 6.

Finally switching stage IX, with the highest heating output power, involves parallel connection of all four heating conductors 4, 5, 6 and 7 relative to each other. In that configuration the pole 20 of the ten-stage switch 16 is connected both to the first and to the second terminals 12 and 11. In that configuration the second pole 19 of the ten-stage switch 16 is connected to the terminals 8, 9 and 10.

The last switching stage OFF corresponds in principle once again to the equivalent circuit shown in FIG. 2.

The illustrated ten-stage switch 16 according to the invention is fundamentally based on more simultaneously heated heating conductors than is hitherto known in the state of the art. A homogenous linear output power distribution is achieved by way of that ten-stage circuitry. The hot plate for keeping food hot corresponding to switching stage I has only a minimal output power of about 100 watts, with the heating output power being distributed to the hot plate over its entire area. A further advantage is that the level of heating output power is higher in the respective outer region of the heating element 1 than in the inner region. That takes account of the fact that a relatively high level of emission of heat occurs in the region of each of the cooking edges, to the cooking pot edges.

Heating conductors 4, 5, 6 and 7 of different resistance values can be used, according to the diameters of the carrier dishes 2. In that connection the changes in resistance vary by virtue of different levels of total output power. Thus, purely by way of calculation, there is also a different distribution of power from the switching stage I to the switching stage IX. With a diameter of the carrier dish 2 or the hot plate of 145 millimetres, the power curve runs from 92 W (switching stage I) to 1200 W (switching stage IX). With a diameter of 180 millimetres the power values are 129 W and 1700 W, while with a diameter of 210 millimetres they are correspondingly 158 W and 2100 W.

We claim:

1. A heating element, comprising a radiant heating body for glass ceramic hobs, including four heating conductors (4, 5, 6, 7) which extend substantially concentrically and parallel to each other; and a ten-stage switch (16) for switching said heating conductors through the intermediary of five output terminals (8, 9, 10, 11, 12).

2. A heating element as set forth in claim 1, wherein five output terminals have a first terminal (12) is connected to the first (4), second (5) and third heating conductors (6), a second terminal (11) is connected to a free feed line (15) of the fourth heating conductor (7), a third terminal (10) is connected to the third (6) and fourth heating conductor (7), a fourth terminal (9) is connected to a free feed line (14) of the second heating conductor (5) and a fifth terminal (8) is connected to a free feed line (13) of the first heating conductor (4).

3. A heating element as set forth in claim 1, wherein at least two heating conductors (4, 5, 6, 7) are switched on when the ten-stage switch (16) is switched into switching stages I and II and IV through IX.

4. A heating element as set forth in claim 1, wherein a respective outer-ring heating conductor (4) of the heating element (1) has the highest rated power relative to the other heating conductors (5, 6, 7) of the same heating element (1).

5. A heating element as set forth in claim 1, wherein at least three heating conductors (4, 5, 6, 7) are switched on in at least half the switching stages of the ten-stage switch (16).

6. A heating element as set forth in claim 2, wherein in switching stage I the ten-stage switch (16) contacts the second (11) and fourth terminals (9), in switching stage II the switch contacts the fourth (9) and the fifth terminals (8), in switching stage III the switch contacts the first (12) and fourth terminals (9), in switching stage IV the switch contacts the second terminal (11) and with the second pole (19) the third (10) and fifth terminals (8), in switching stage V the switch contacts the first (12) and second terminals (11) with a first pole (20) and the third terminal (1), in switching stage VI the switch contacts the first terminal (12) and with a second pole (19) the third (10) and fifth terminals (8), in switching stage VII with the first pole (20) contacts the first (12) and second terminals (11) and with the second pole (19) contacts the third (10) and fourth terminals (9), in switching stage VIII the switch contacts the first terminal (12) and with the second pole (19) contacts the third (10), fourth (9) and fifth terminals (8), and in switching stage IX with the first pole (20) contacts the first (12) and second terminals (11) and with the second pole (19) contacts the third (10), fourth (9) and fifth terminals (8).

7. A heating element as set forth in claim 1, wherein the heating power of the heating element (1) rises substantially approximately linearly from switching stage I to switching stage IX.

8. A heating element as set forth in claim 1, wherein the switching stage I corresponds to the stage for keeping food hot by said heating conductors (5, 6, 7) which are connected in series.

* * * * *

UNITED STATES PATENT AND TRADEMARK OFFICE

CERTIFICATE OF CORRECTION

PATENT NO. : 5,864,121

DATED : January 26, 1999

INVENTOR(S) : Jorg Meyer, et al.

It is certified that error appears in the above-identified patent and that said Letters Patent are hereby corrected as shown below:

On The Title Page, [30] Foreign Application Priority Data: "Jul. 15, 1996" should read

--Jan. 9, 1996--

Signed and Sealed this

First Day of May, 2001

*Attest:*

Nicholas P. Godici

NICHOLAS P. GODICI

*Attesting Officer*

*Acting Director of the United States Patent and Trademark Office*